US011027393B2

(12) United States Patent
Brouk

(10) Patent No.: US 11,027,393 B2
(45) Date of Patent: Jun. 8, 2021

(54) ADJUSTABLE SANDER PAD ASSEMBLY

(71) Applicant: Jason Brouk, Imperial, MO (US)

(72) Inventor: Jason Brouk, Imperial, MO (US)

( * ) Notice: Subject to any disclaimer, the term of this patent is extended or adjusted under 35 U.S.C. 154(b) by 392 days.

(21) Appl. No.: 15/970,844

(22) Filed: May 3, 2018

(65) Prior Publication Data

US 2019/0134773 A1 May 9, 2019

Related U.S. Application Data

(60) Provisional application No. 62/503,245, filed on May 8, 2017.

(51) Int. Cl.
*B24B 23/04* (2006.01)
*B24D 9/08* (2006.01)

(52) U.S. Cl.
CPC ..... *B24B 23/04* (2013.01); *B24D 9/08* (2013.01)

(58) Field of Classification Search
CPC . B24D 5/16; B24D 5/165; B24D 7/02; B24D 7/04; B24D 7/16; B24D 7/18; B24D 9/085; B24B 23/022; B24B 23/04; B24B 23/08; B24B 7/168; B24B 23/02; B24B 27/08; B24B 41/047
USPC ..... 451/353, 359
See application file for complete search history.

(56) References Cited

U.S. PATENT DOCUMENTS 1,000,696 A * 8/1911 Schlueter ..... B24B 7/186 451/353
1,932,319 A * 10/1933 Myers ..... B24B 41/047 451/353
3,510,992 A 5/1970 Hutchins
4,058,936 A 11/1977 Marton
4,287,685 A 9/1981 Marton
4,730,952 A * 3/1988 Wiley ..... B24B 45/006 30/388
5,545,082 A 8/1996 Courson
5,690,545 A 11/1997 Clowers
5,938,514 A 8/1999 Amin
6,110,028 A * 8/2000 Chung ..... B24B 23/02 451/359
6,523,214 B1 2/2003 Kaiser
6,840,849 B2 1/2005 Mackay
7,252,580 B2 * 8/2007 Lin ..... B24B 45/006 451/295
7,261,623 B1 8/2007 Palushi
7,690,970 B2 4/2010 Palushaj
(Continued)

FOREIGN PATENT DOCUMENTS

WO WO-2017186551 A1 * 11/2017 ..... B24D 5/16

*Primary Examiner* — Orlando E Aviles
*Assistant Examiner* — Joel D Crandall
(74) *Attorney, Agent, or Firm* — Linda L. Lewis

(57) ABSTRACT

An adjustable sander pad assembly comprising a backer flange, multiple support fingers, multiple adjustment supports, a sander plate, and an adjustment ring; wherein the multiple support fingers each has a first and a second attachment point, wherein the first attachment point is attached to the adjustment support, wherein the second attachment point is attached to the adjustment ring, wherein the support fingers, the adjustment supports, the sander plate, and the adjustment ring are mounted on the backer flange, and wherein the adjustment ring is rotated to move the support fingers and adjustment supports radially from a retracted position to an extended position.

9 Claims, 8 Drawing Sheets

(56) References Cited

U.S. PATENT DOCUMENTS

| | | | | |
|---|---|---|---|---|
| 8,727,837 | B2 * | 5/2014 | Weder | B24B 7/00 451/353 |
| 2010/0144250 | A1 * | 6/2010 | Kilgren | B24B 7/22 451/353 |
| 2011/0306280 | A1 * | 12/2011 | Weder | B24B 7/186 451/259 |
| 2016/0234671 | A1 * | 8/2016 | Chai | H04W 76/14 |
| 2016/0243671 | A1 * | 8/2016 | Holiness-Stalling | B24B 5/42 |

* cited by examiner

ADJUSTABLE SANDER PAD ASSEMBLY

CROSS-REFERENCE TO RELATED APPLICATIONS

This utility patent application claims the benefit of provisional patent application 62/503,245 filed May 8, 2017, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to rotary floor sanders, and more particularly to an adjustable sander pad assembly for rotary floor sanders that provides adjustable stiffness of the sanding pad for improved sanding of surfaces.

Related Art

For years now professional floorers and do it yourselfers have been finishing their hardwood floors in their homes with equipment that consists of machines like industrial grade 7" rotary floor sander edgers that use a sander pad. This machine performs the task of sanding the floor at the base of a wall where the larger floor sanders cannot reach. This machine will take the top layer of wood surface from the floor to expose the undamaged unvarnished wood to later refinish for a greater appearance. During the process of sanding the floor the process has multiple steps requiring different amounts of stiffness in the sander pad.

The first step in edging along the base of a wall is to use the 7" floor sander edger with a rotating tool that is usually rigid enough to allow for the abrasive surface that is applied to the tool to remove greater amounts of wood when pressure is applied. This process removes the surface varnish previously applied to the floor and also deep surface abrasions in the floor. The second step is to replace the rigid sanding pad for one that is more flexible to sand finer details. The process of removing the sander pad from the rotary sander and replacing it with a different pad can be a complicated and time-consuming one.

The present invention allows the changing of the sander pad from a stiffer pad to a more flexible pad with a simple adjustment that is quick and easy by using the claimed adjustable sander pad assembly.

SUMMARY OF THE INVENTION

An adjustable sander pad assembly having a backer flange, multiple support fingers, multiple adjustment supports, and an adjustment ring where the multiple support fingers each has a first and a second attachment point and where the first attachment point is attached to the adjustment support and the second attachment point is attached to the adjustment ring. The support fingers, the adjustment supports and the adjustment ring are mounted on the backer flange. The adjustment ring is rotated to move the support fingers and adjustment supports radially from a retracted support position to an extended support position.

Preferably, the adjustable sander pad assembly also has a sander plate, a fixing ring, and a flex plate. The sander plate is mounted on the backer flange. The fixing ring attaches fixedly to the backer flange and secures the multiple support fingers, the multiple adjustment supports, and the adjustment ring. The flex plate is fixedly attached to the backer flange over the fixing ring.

When the adjustable sander pad assembly is in the extended position, the sander pad assembly is more rigid, and when it is in the retracted position, the sander pad assembly is more flexible.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
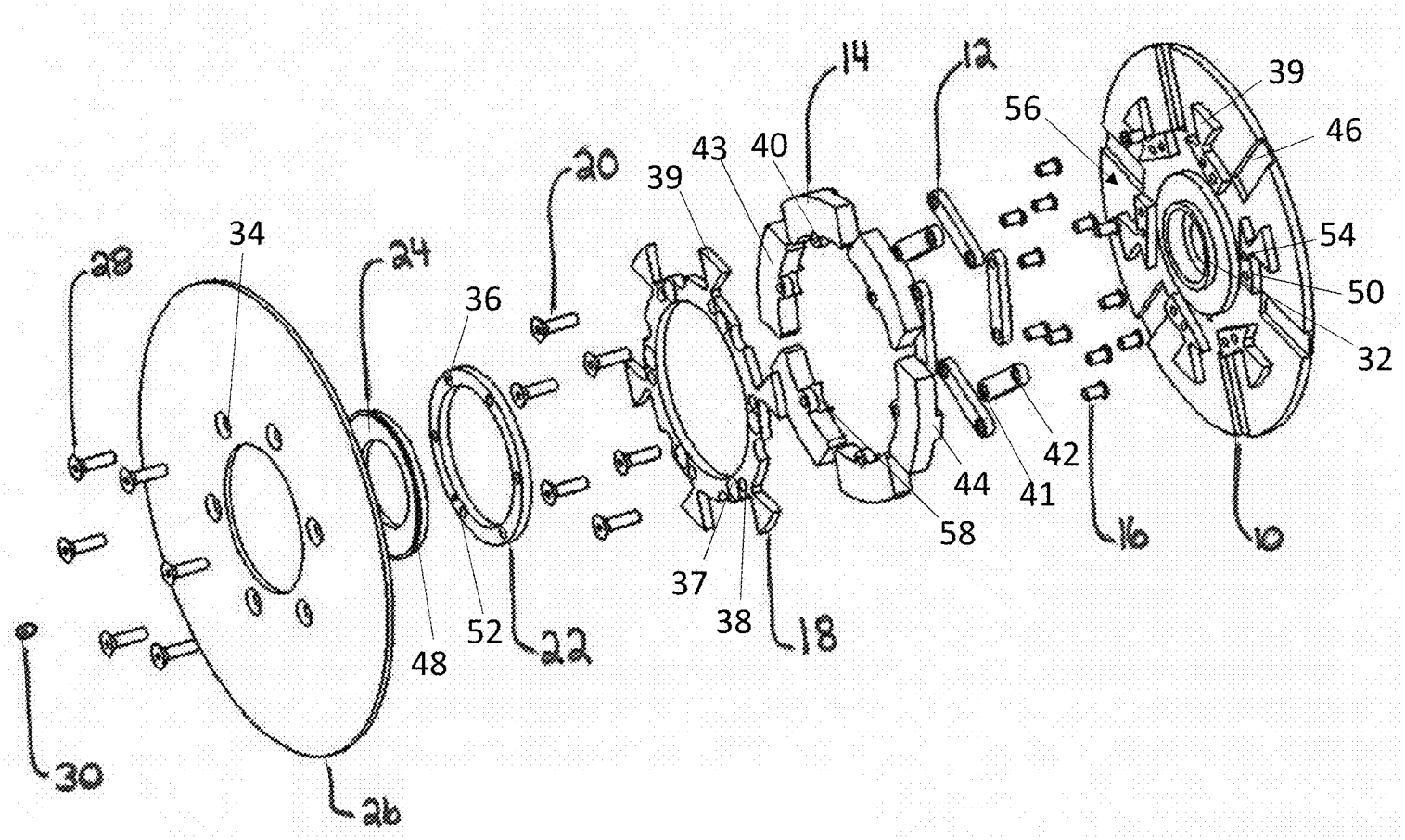
FIG. 1 is an expanded view of a first embodiment of the sander plate assembly of the present invention.

FIG. 1 shows and expanded view of a first embodiment of the sander plate assembly 1 of the present invention. A rotating backer flange 10 has a threaded area and multiple channels 46. In a preferred embodiment, the number of channels 46 is six, but that number can vary from about 2 to 10. The channels extend radially from about mid-radius of the backer flange 10 to the outer edge of the flange. In a preferred embodiment, the length of the channel, d, is about half of the radius of the backer flange 10. In a more preferred embodiment, the length of the channel, d, is greater than the radius of the backer flange 10.

Figure 8:
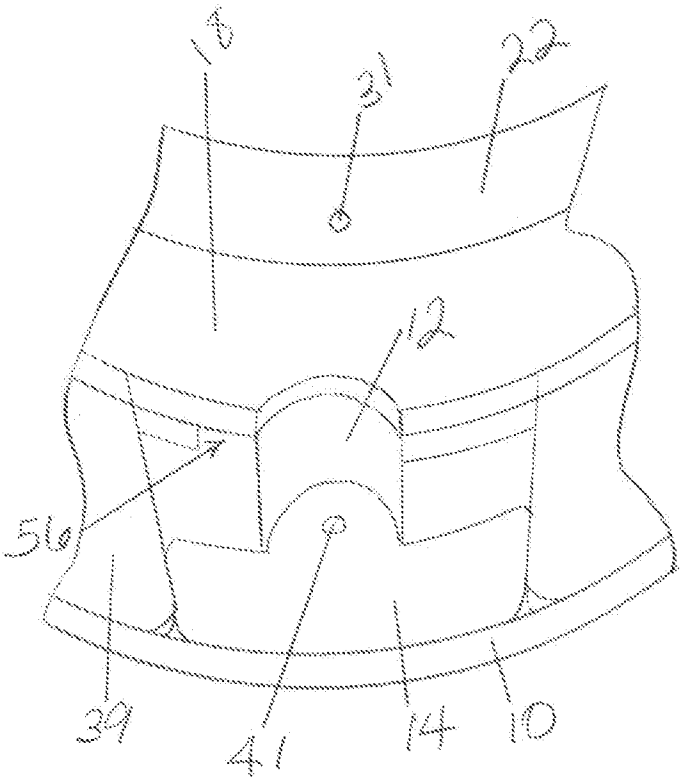
FIG. 8 is a partial plane view of the sander plate assembly without the flex plate in the extended position.

Adjacent the channels 46 are guide mounts 33 that have pairs of threaded screw holes 50 and 54. As shown in FIG. 8, the guide mount 33 must be thicker than the support fingers 12 to provide space 56 for the fingers to move. Preferably, the backer flange is circular, essentially planar and had a center opening.

Support fingers 12 are essentially elongated and narrow. They have a first attachment point 41 and a second attachment point 42, one at each end. Typically, the number of support fingers 12 is the same as the number of channels 46. The adjustment supports 14 have an essentially planar top 43 and a bottom surface with a radial projection 44. The radial projection 44 is sized to moveably nest inside the channel 46.

Figure 2:
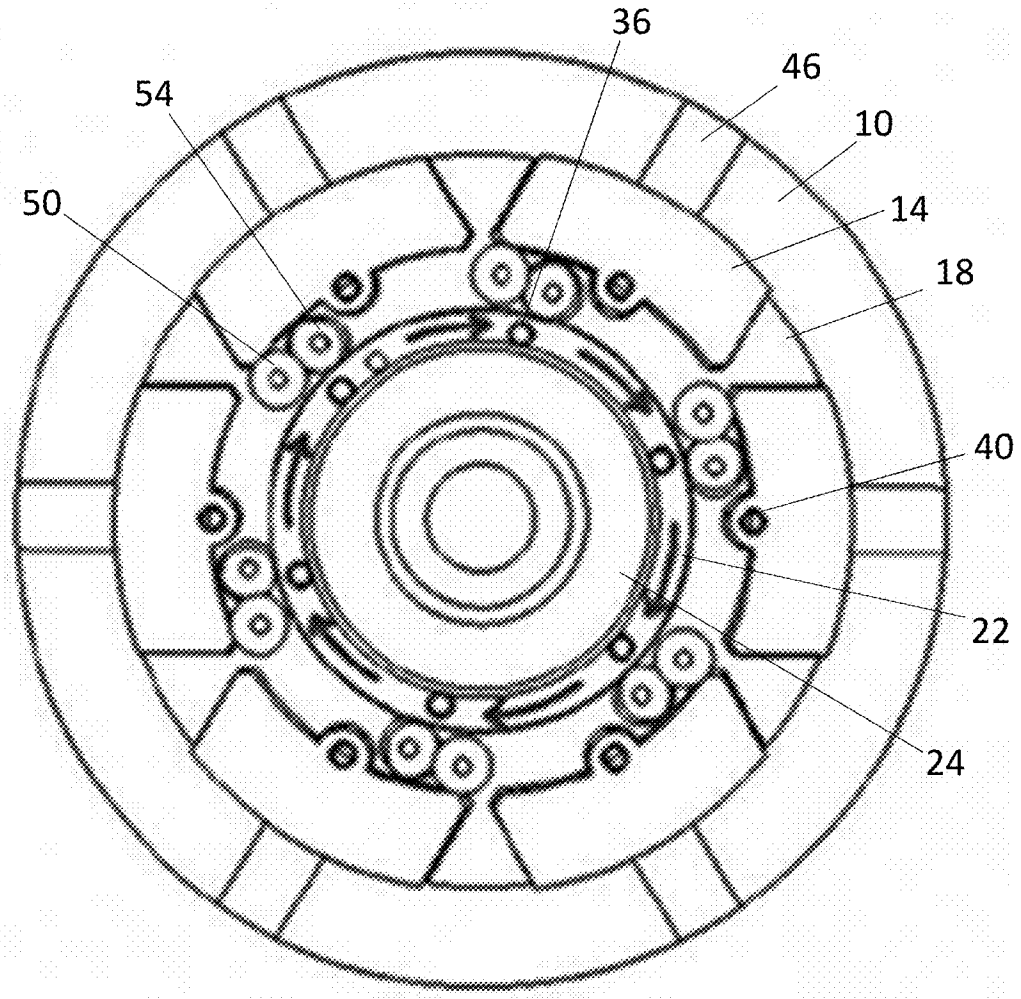
FIG. 2 is a plane view of the sander plate assembly without the flex plate in the retracted position.
Figure 3:
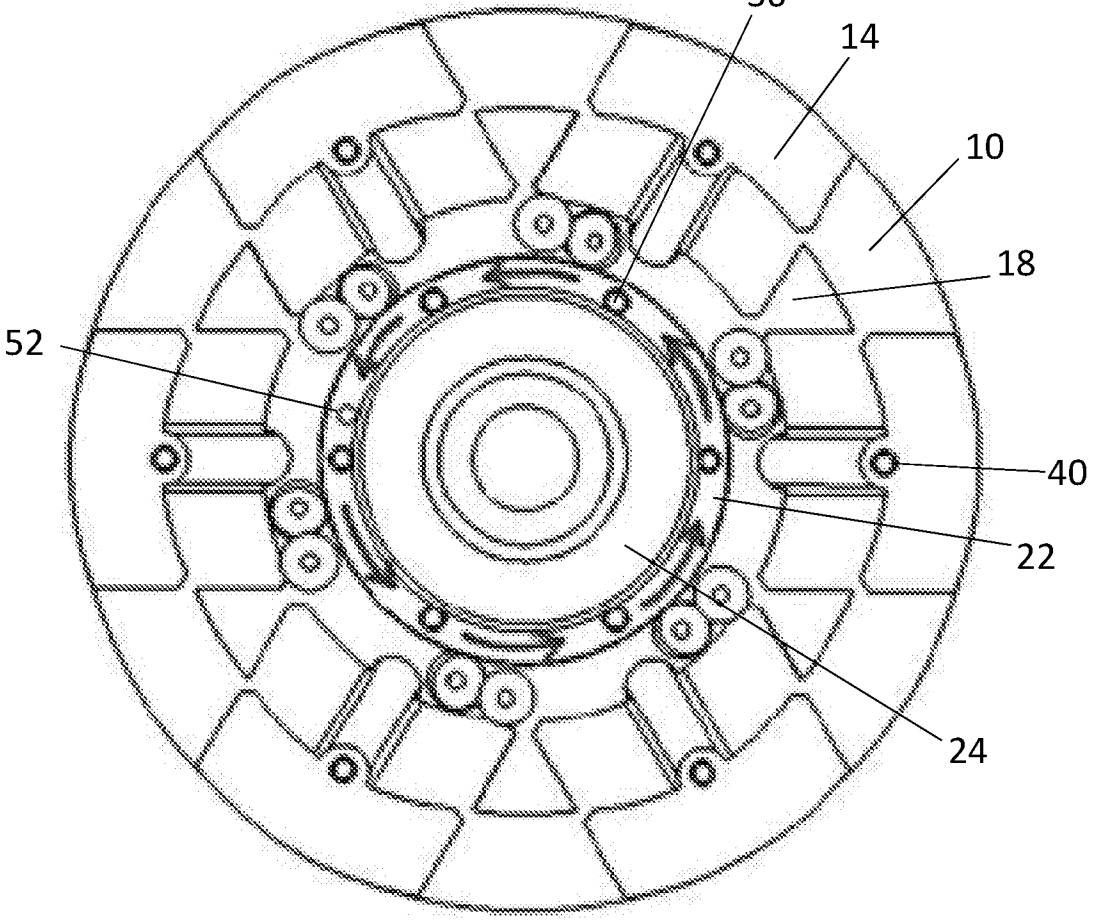
FIG. 3 is a plane view of the sander plate assembly without the flex plate in the extended position.

As shown in FIG. 8, the adjustable supports are sufficiently wide that in either the extended or retracted position, the essentially planar top 43 provides support for the flex plate 26. The depth of the adjustable supports, b, is sufficient to provide stiffening to the sander. In a preferred embodiment, the depth of the adjustable supports is 10% of the radius of the backer flange. In a more preferred embodiment, the depth of the adjustable supports is greater than 10% of the radius of the backer flange. The number of adjustable supports 14 is the same as the number of support fingers 12. The adjustable supports 14 are rotatably attached to the support finger first attachment point 41 at openings 40, typically by attachment pins or bearings 16. Preferably, the openings 40 have a space 58 below the opening, allowing the support finger to be attached and move beneath the sander plate 18. The attachment pins or bearings 16 are also used to rotatably attach the second attachment point 42 of the support fingers 12 to the adjustment ring 22 at attachment ring openings 36. The adjustment ring 22 is used to move the adjustment supports 14 from the retracted position (see FIG. 2) to the extended position (see FIG. 3) and back by rotating clockwise and counterclockwise. In a preferred embodiment, the adjustment ring 22 is fixed in position using a set screw 30 at screw opening 52.

Figure 6:
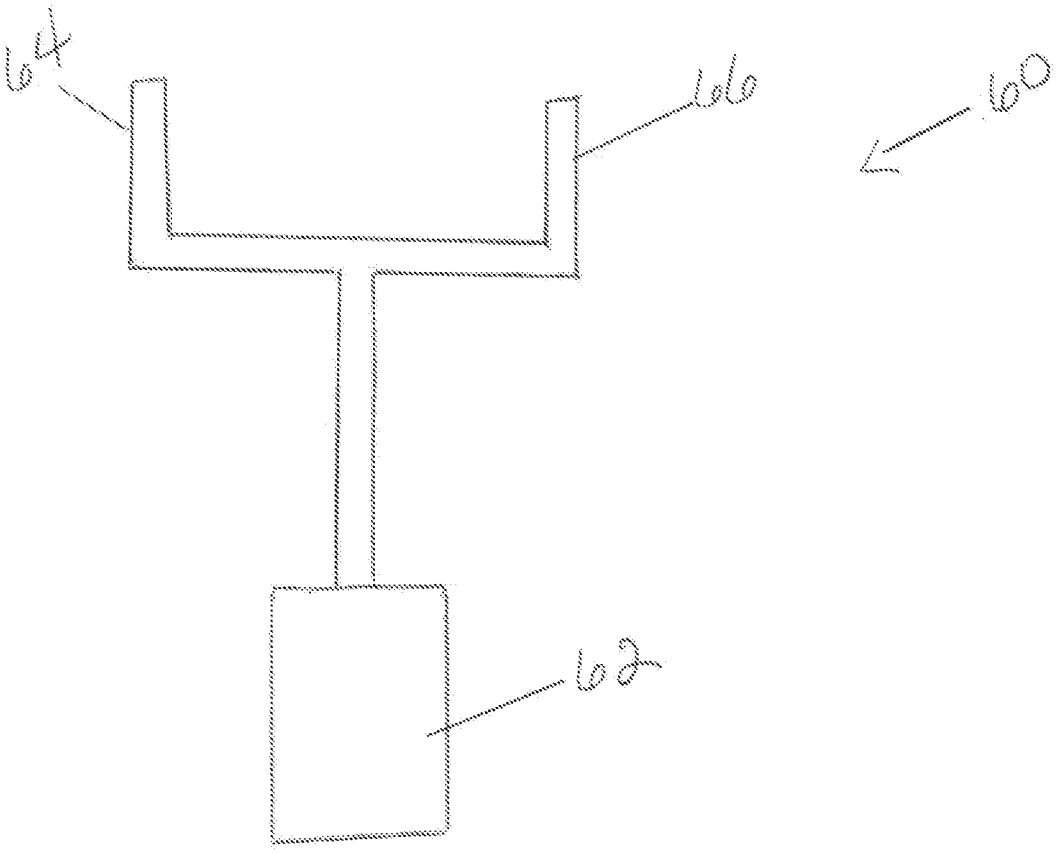
FIG. 6 is a perspective view of the key of the present invention.
Figure 7:
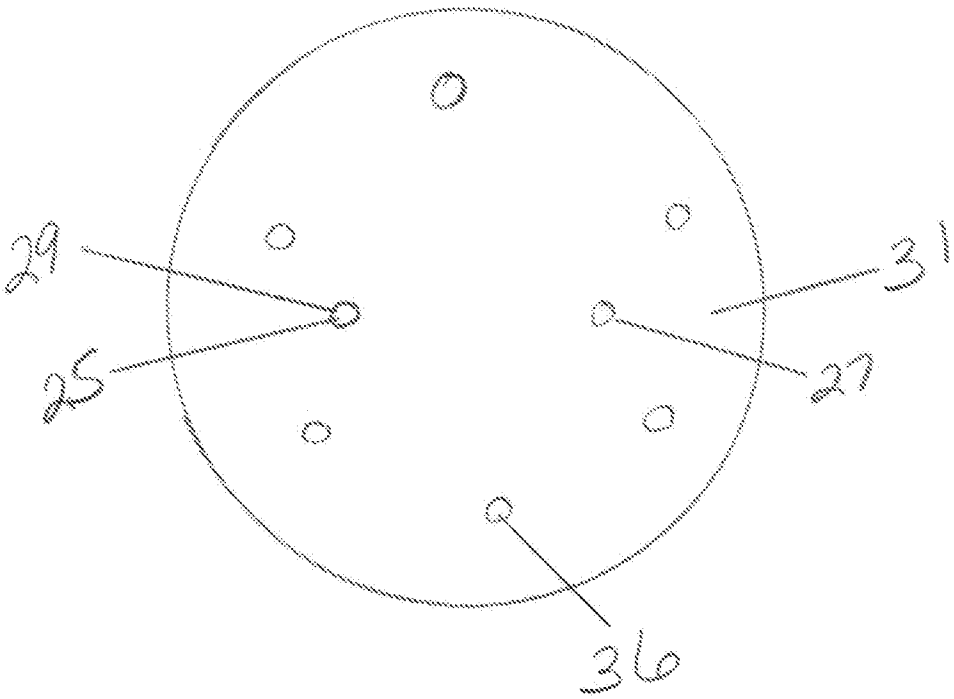
FIG. 7 is a perspective view of a second embodiment of the key adjustment ring.

As shown in FIG. 6, in a second preferred embodiment, the adjustment key ring 31 is turned using by means of a key 60. The key has a handle 62 and two prongs 64 and 66. As shown in FIG. 7, the key is inserted into the two key openings 25 and 27 in the adjustment key ring 31. Preferably, below at least one of key openings 25 and 27 is a spring-mounted retainer button 29. The button engages with at least one of the openings when the adjustment supports are in the retracted position, securing it in the retracted position. When moving to the extended position, the two prongs are inserted into the two openings, thereby depressing the retainer button 29 and allowing the fixing ring and adjustment ring to be rotated to the extended position.

A sander plate 18 is used to fix the support fingers 12, the adjustment supports 14 and the adjustment ring 22 in place on the backer flange 10 by attaching to the guide mounts 33. When mounted to the backer flange 10, a finger space 56 is created between the sander plate and the backer flange that allows the finger supports to move from the retracted to the extended positions. The sander plate is circular with a central opening and guides 39 extending outward radially. There the same number of guides as there are adjustment supports, and the guides are designed to nest between the adjustment supports when they are in either the retracted position or the extended. Preferably, the guides are tapered inward toward the center of the sander plate. In a preferred embodiment, the guides are dovetailed to hold the adjustment supports in place when the flex plate 26 is removed. Preferably, the adjustment supports are likewise dovetailed to nest in the guides. Screws 20 are mounted through the sander plate 18 at screw holes 38 into the backer flange 10 at threaded screw holes 50.

In a first embodiment, fixing ring 24 has threads 48 on its perimeter that fixedly attached to the threaded portion 32 of backer flange 10. When attached, it mounts the support fingers, adjustment supports and adjustment ring to the backer flange.

A flex plate 26 is fastened over the remaining components by flex plate screws 28 which pass through the sander plate at openings 37 and mount on backer flange 10 in screw holes 50.

The purpose of the adjustable sander pad assembly is to remove the need to disassemble the tooling for the 7" floor sander edger when increasing or decreasing flexibility. The adjustable sander pad assembly 1 is mounted onto the jackshaft of the 7" floor sander edger. Sandpaper is attached to the surface of the flex plate 26. Tipping the 7" floor sander edger so that the backer flange 10 is facing the user, the set screw 30 is located and a hex tool is used to loosen the screw until adjustment ring 22 is able to rotate freely. There are two positions that the adjustment ring 22 can be rotated to and locked: the extended position and the retracted position. When the adjustment ring 22 is rotated the components that are retained by the sander plate 18 extend or retract the components that are tied to the adjustment ring 22. Attached to the adjustment ring 22 are the support fingers 12 and the adjustment supports 14. In this embodiment, there are six of these components around the circumference of the backer flange 10 and attached to the adjustment ring 22. These components are able to pivot at the first and second attachment points 42 by use of a bearing or pin 16. When the adjustment ring 22 is rotated to the desired position, the radial projection 44 on the bottom of the adjustment support 14 moves in the channel 46 on the backer flange 10. The adjustment support is sandwiched between the backer flange 10 and the flex plate 26, but is able to move freely.

When the user of the sander tool needs more rigidity for more aggressive sanding, the adjustment ring 22 is rotated counter clockwise to extend the adjustment supports to the outer edge of the backer flange 10. See FIG. 3. The set screw 30 locks the adjustment ring 22 into place. When the flexibility adjustment supports are extended, the pressure that is applied to the flex plate 26 will be increased because of the support behind the plate 26 by the adjustment supports 14. The tool is ready to use at this time.

When it is desired that the sanding tool needs to be more flexible for finer sanding, the adjustment screw is loosened and the ring 22 is rotated clockwise to retract the adjustment supports away from the outer edge of the backer flange 10. See FIG. 2. The set screw 30 is used to lock the adjustment ring 22 in place. When the flexibility adjustment supports are retracted, the pressure applied to the flex plate 26 is less, because of the lack of support behind the plate 26 by the adjustment supports 14. The tool is ready to use at this time.

Figure 4:
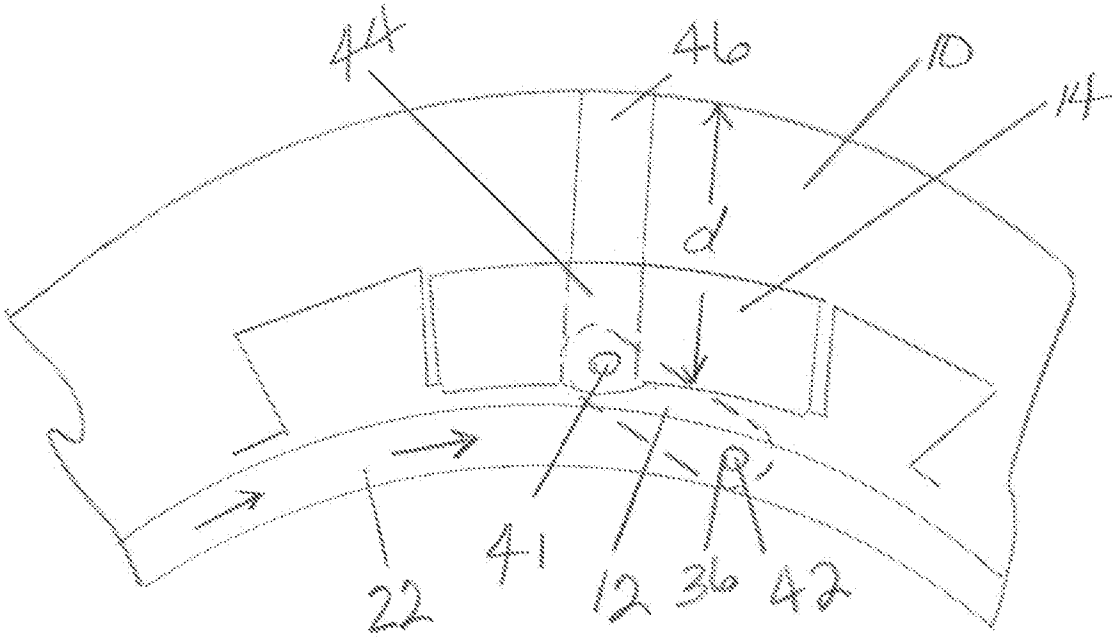
FIG. 4 is a partial plane view of the sander plate assembly without the flex plate in the retracted position.
Figure 5:
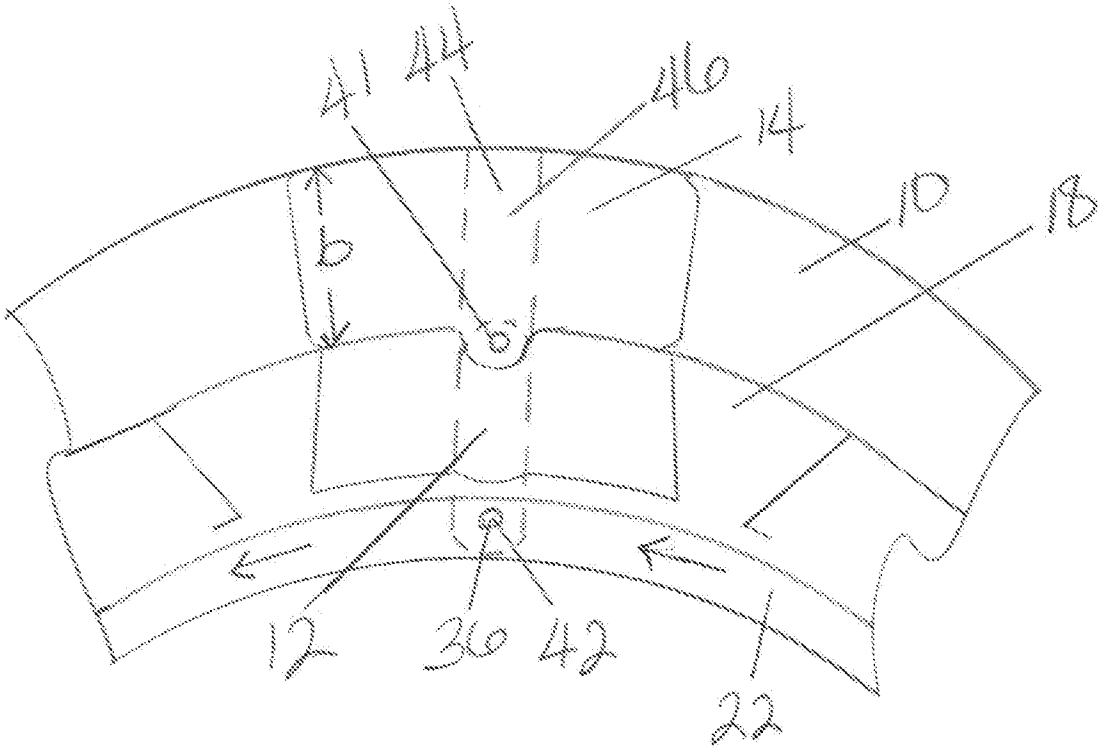
FIG. 5 is a partial plane view of the sander plate assembly without the flex plate in the extended position.

As shown in FIGS. 4 and 5, the rotating of the adjustable ring 22 clockwise moves the support fingers 12 to retract the adjustment supports 14 by the radial projections 44 radially along the channel 46. Rotating the adjustable ring 22 counterclockwise moves the support fingers 12 to extend the adjustment supports by the radial projections 44 radially along the channel 46.

In the second embodiment, the key 60 is used to rotate the key adjustment ring 31 to move the adjustment supports from the retracted position to the extended position and back. The retainer button 29 locks the adjustment supports in the retracted position, and is released when the key is inserted to turn to the extended position.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An adjustable sander pad assembly for a rotary floor sander providing a stiff sander pad position and a flexible sander pad position for sanding surfaces comprising;

a flex plate;

a sander plate fixedly mounted on the flex plate and a backer flange fixedly mounted on the sander plate;

multiple support fingers having a finger thickness, multiple adjustment supports and an adjustment ring moveably mounted together and positioned between the flex plate and the backer flange;

wherein the multiple support fingers are elongated and narrow, and have a first and a second attachment point at each respective end;

wherein the first attachment point is movably attached to an adjustment support;

wherein the second attachment point is movably attached to the adjustment ring;

wherein the backer flange is circular with a center opening and a radius;

wherein the backer flange has radial channels;

wherein the length of the radial channels is from about half to more than half of the radius of the backer flange;

wherein the backer flange has guide mounts having a guide mount thickness;

wherein the sander plate is fixedly attached to the guide mounts creating a finger space in which the support fingers move;

wherein the multiple adjustment supports have a plurality of radial projections;

wherein the radial projections are movably engaged with the radial channels;

wherein the adjustment ring can be rotated to move the support fingers;

wherein the adjustment supports are moved radially by the support fingers from a retracted position to an extended position and back; and wherein when operating the rotary sander in the extended position the sander pad assembly is more rigid and wherein when operating the rotary sander in the retracted position the sander pad assembly is more flexible for sanding surfaces.

2. The adjustable sander pad assembly of claim 1, wherein the sander plate has a plurality of guides;

wherein the guides nest between the adjustment supports; and wherein the guides extend outward radially.

3. The adjustable sander pad assembly of claim 2, wherein the plurality of guides are tapered inward toward the center of the sander plate.

4. The adjustable sander pad assembly of claim 3, wherein the plurality of guides, the fingers, the adjustment supports and the guide mounts respectively comprise a number of from 2 to 10.

5. The adjustable sander pad assembly of claim 3, wherein the plurality of guides, the fingers, the adjustment supports and the guide mounts respectively comprise a number of from 4 to 8.

6. The adjustable sander pad assembly of claim 2, wherein the guide mount thickness is greater than the finger thickness.

7. An adjustable sander pad assembly for a rotary floor sander providing a stiff sander pad position and a flexible sander pad position for sanding surfaces comprising;

a flex plate;

a sander plate fixedly mounted on the flex plate and a backer flange fixedly mounted on the sander plate;

multiple support fingers having a finger thickness, multiple adjustment supports and an adjustment ring moveably mounted together and positioned between the flex plate and the backer flange;

wherein there are from 2 to 8 support fingers and adjustment supports;

wherein the multiple support fingers are elongated and narrow, and have a first and a second attachment point at each respective end;

wherein the first attachment point is movably attached to an adjustment support;

wherein the second attachment point is movably attached to the adjustment ring;

wherein the backer flange is circular with a center opening and a radius;

wherein the backer flange has radial channels;

wherein the length of the radial channels is from about half to more than half of the radius of the backer flange;

wherein the backer flange has guide mounts having a guide mount thickness;

wherein the sander plate is fixedly attached to the guide mounts creating a finger space in which the support fingers move;

wherein the multiple adjustment supports have a plurality of radial projections;

wherein the radial projections are movably engaged with the radial;

wherein the adjustment ring can be rotated to move the support fingers;

wherein the adjustment supports are moved radially by the support fingers from a retracted position to an extended position and back; and wherein when operating the rotary sander in the extended position the sander pad assembly is more rigid and wherein when operating the rotary sander in the retracted position the sander pad assembly is more flexible for sanding surfaces.

8. The adjustable sander pad assembly of claim 7, wherein the guide mount thickness is greater than the finger thickness.

9. The adjustable sander pad assembly of claim 7, further comprising a fixing ring fixedly mounted on the backer flange.

* * * * *